US005694983A

United States Patent [19]

Kusakari et al.

[11] Patent Number: 5,694,983

[45] Date of Patent: Dec. 9, 1997

[54] REINFORCING BAR BINDING MACHINE

[75] Inventors: Ichiro Kusakari; Atsushi Miyazaki, both of Tokyo, Japan

[73] Assignee: Max Co., Ltd., Tokyo, Japan

[21] Appl. No.: 613,239

[22] Filed: Mar. 8, 1996

[30] Foreign Application Priority Data

Mar. 10, 1995 [JP] Japan ..... Hei. 7-079896
Jun. 30, 1995 [JP] Japan ..... Hei. 7-188123

[51] Int. Cl.[6] ..... B21F 27/08

[52] U.S. Cl. ..... 140/119; 140/57

[58] Field of Search ..... 140/57, 93 A, 140/119

[56] References Cited

U.S. PATENT DOCUMENTS

| | | | |
|---|---|---|---|
| 3,323,558 | 6/1967 | Collins | 140/93 A |
| 4,362,192 | 12/1982 | Furlong et al. | 140/93.6 |
| 4,834,148 | 5/1989 | Muguruma et al. | 140/119 |

FOREIGN PATENT DOCUMENTS

| | | |
|---|---|---|
| 0 190 071 | 8/1986 | European Pat. Off. . |
| 0 249 737 | 12/1987 | European Pat. Off. . |
| 0 388 350 | 9/1990 | European Pat. Off. . |
| 27 20 027 | 12/1977 | Germany . |
| 5-3494 | 1/1993 | Japan . |
| 2 171 038 | 8/1986 | United Kingdom . |

*Primary Examiner*—Lowell A. Larson
*Attorney, Agent, or Firm*—Cushman Darby & Cushman IP Group of Pillsbury Madison & Sutro LLP

[57] ABSTRACT

A wire winding guide for a reinforcing bar binding machine in which reinforcing bars are bound with a wire, the wire winding guide includes: a wire feed device for feeding the wire to bind the reinforcing bars; a guide portion for curling the wire fed out from the wire feed device so as to form the wire into a loop; a twisting hook for holding a portion of the wire wound and twisting the wire; a cutting device for cutting off the loop of the wire from the primary wire; a first and a second guide arm for guiding and holding the loop-shaped wire fed out from the guide portion, wherein the first and the second guide arm are arranged in the front of the twisting hook being opposed to each other; and a contact portion arranged close to the twisting hook, coming into contact with a crossing portion of the reinforcing bars in the process of binding.

3 Claims, 8 Drawing Sheets

FIG. 7(a)
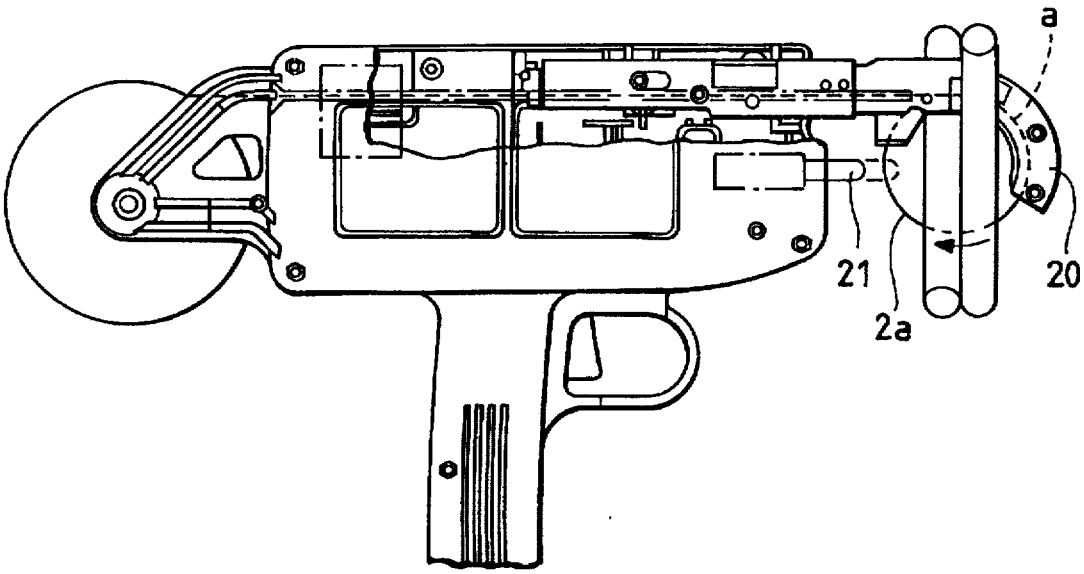
FIG. 7(b)
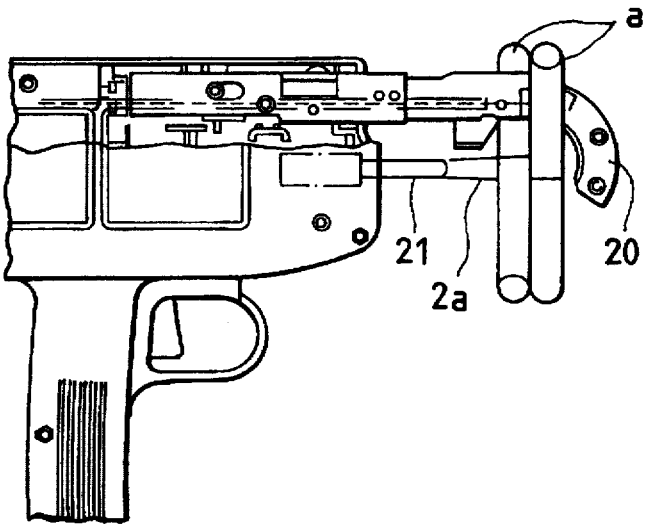
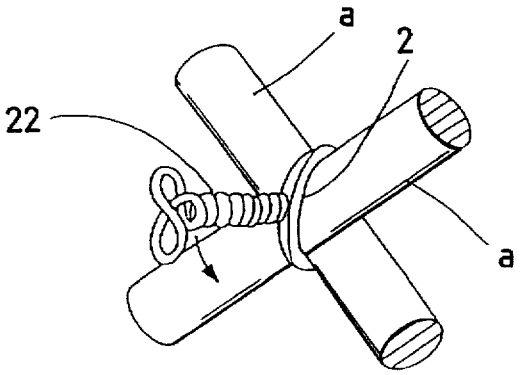
FIG. 7(c)

REINFORCING BAR BINDING MACHINE

BACKGROUND OF THE INVENTION

The present invention relates to a guide device and a twisting mechanism of a reinforcing bar binding machine for effectively binding reinforcing bars with a binding wire when it is fed from a curved guide arm in a loop-shape and wound around a crossing portion of the reinforcing bars by a plurality of times and then twisting a portion of the loop to be bound.

In general, in the construction work of buildings and structures in which reinforced concrete is used, concrete is poured after reinforcing bars have been crossed and bound. In this case, the reinforcing bars are bound by a reinforcing bar binding machine recently. As disclosed in Japanese Utility Model Application Laid-open No. 5-3494 applied by the present applicant, in this reinforcing bar binding machine, after a binding wire has been wound around the reinforcing bars in a loop-shape, a portion of the loop of the binding wire is held by a hook and rotated and twisted for binding the wire.

As shown in FIG. 7(*a*), according to this binding system, reinforcing bars are bound by the wire 2 as follows. There is provided a guide arm 20 by which the wire 2 is curled so that it can be formed into a loop-shape. After the reinforcing bars have been caught by the inside portion of the guide arm 20, the wire 2 is fed and wound around the reinforcing bars, and further a portion of the wire loop 2*a* is held and rotated by the twisting hook 21, so that the reinforcing bars can be bound with the wire. However, when the twisting hook 21 is rotated, the wire loop is also given a force perpendicular to the radial direction. Accordingly, the wire loop is shifted in the transverse direction. Therefore, a portion of the wire 2 is caught in a portion of the reinforcing bars "a" which is distant from a crossing portion of the reinforcing bars "a", which causes a faulty binding of the reinforcing bars. In order to solve the above problems, it is necessary to draw the reinforcing bar binding machine to the operator's side so as to give a tension to the wire loop 2*a* and make the wire 2 to closely come into contact with the crossing portion of the reinforcing bars "a", and then the wire is twisted.

When the reinforcing bar binding machine is drawn as described above, a long twisting portion 22 of the wire is formed and raised perpendicularly to the reinforcing bar face as shown in FIG. 7(*c*). Therefore, when concrete is placed in this condition, the twisting portion 22 of the wire is protruded from the concrete face. In order to avoid the occurrence of the above problems, it is necessary to bend the twisting portion 22 of the wire as shown by an arrow in the drawing. However, when the twisting portion 22 is bent, the binding wire is loosened and the binding force is lowered.

Usually, the twisting hook is arranged at the rear of a wire loop. After the wire has been wound around the reinforcing bars, the twisting hook is linearly moved toward the reinforcing bars to a position at which the twisting hook can hold the wire, and then the twisting hook is closed so as to hold the wire. After that, the twisting hook is rotated so as to twist and bind the wire.

As described above, the twisting hook conducts a linear motion, an opening and closing motion, and a rotary motion. Accordingly, the structure of the twisting hook becomes complicated and the cost is raised. Further, the installation space extends and the weight increases.

An object of the present invention is to provide a winding guide for a binding wire of a reinforcing bar binding machine by which the reinforcing bars can be simply and positively bound without requiring additional steps such as drawing the binding machine or bending the twisting portion of the binding wire.

Another object of the present invention is to provide a twisting mechanism for a binding wire of a reinforcing bar binding machine, by which the binding wire can be twisted and bound with a simple structure.

SUMMARY OF THE INVENTION

In order to accomplish the above objects, the present invention is to provide a winding guide for a binding wire of a reinforcing bar binding machine comprising: a wire feed device for feeding a wire to bind reinforcing bars; a guide portion for curling the wire fed out from the wire feed device so as to form the wire into a loop; a twisting hook for twisting the wound wire by holding a portion of the wire; a cutting device for cutting off the loop of the wire from the primary wire; a first and a second guide arm for guiding and holding the loop-shaped wire fed out from the guide portion, wherein the first and the second guide arm are arranged in the front of the twisting hook being opposed to each other; and a contact portion arranged close to the twisting hook, coming into contact with a crossing portion of the reinforcing bars.

In this connection, it is preferable that the first and the second guide arm are capable of opening and closing and pushed in the closing direction at all times.

In order to accomplish the above objects, according to another aspect, the present invention is to provide a twisting mechanism for a binding wire of a reinforcing bar binding machine, the reinforcing bar binding machine comprising: a wire feed device for feeding a wire to bind reinforcing bars; and a guide portion for curling the wire sent out from the wire feed device so as to form the wire into a loop, the twisting mechanism including a twisting shaft having a split groove at its end into which the loop-shaped wire is inserted, wherein a portion of the wire inserted into the split groove is twisted and bound by rotating the twisting shaft after the wire has been wound around reinforcing bars.

According to the invention described above, the crossing portion of reinforcing bars is inserted between the first and the second guide arm of the reinforcing bar binding machine, and the contact portion of the reinforcing bar binding machine is contacted with the reinforcing bars. Under the above condition, the reinforcing bar binding machine is operated. Then the binding wire is fed by the wire feed device and guided by the guide portion and wound around the crossing portion of the reinforcing bars by one turn being formed into a loop-shape. In the same manner, the binding wire is wound around the crossing portion of the reinforcing bars in the second, third and fourth turns being formed into a loop-shape. The thus formed loop-shaped wire is accommodated inside the groove portions of the first and the second guide arm. After the wire has been wound around the crossing portion of the reinforcing bars by 3 or 4 turns, the feed device is stopped, and the cutting device is operated so as to cut off the wire, and at the same time the twisting device is operated, so that the twisting hook is closed, and a portion of the wire loop is held by the twisting hook and twisted. Due to the foregoing, the crossing portion of the reinforcing bars is strongly bound by the wire. After the crossing portion of the reinforcing bars has been bound by the wire, the twisting hook is disengaged from the wire, and the binding condition of the reinforcing bars can be maintained as it is.

When the binding wire is twisted by the twisting hook as described above, the wire loop is given a force by which the wire loop is shifted in a direction perpendicular to the radial direction of the loop. However, since the wire loop is held in the guide grooves of the first and the second guide arm, the wire loop is not shifted in the transverse direction. Accordingly, even if the reinforcing bar binding machine is not drawn and a tension is not given to the wire, unlike the conventional reinforcing bar binding machine, the occurrence of a faulty binding can be avoided.

It is not necessary to give a tension to the binding wire by separating the reinforcing bar binding machine from the crossing portion of the reinforcing bars. Accordingly, a distance between the wire twisting portion of the hook and the crossing portion of the reinforcing bars can be maintained constant at all times, and the length of the twisting portion of the wire can be reduced, that is, unlike the conventional reinforcing bar binding machine, the rising portion of the twisting wire is not long. Therefore, it is not necessary to pull down the rising portion of the twisting wire.

Further, it is sufficient that the reinforcing bar binding machine is operated in such a manner that the crossing portion of the reinforcing bars is inserted between the first and the second guide arm of the reinforcing bar binding machine, and this motion is linear. When this motion is conducted, the binding machine can be automatically positioned when it is inserted between the guide arms until the contact portion comes into contact with the reinforcing bars.

Furthermore, even if the diameter of the reinforcing bar varies from a large to a small size, the opening formed between the first and the second guide arm can be freely adjusted. Therefore, the reinforcing bars can be automatically held in the best condition between the first and the second guide arm in accordance with the reinforcing bar diameter.

The binding wire is sent out from the wire feed device and wound around the reinforcing bars by a plurality of times by the action of the guide device. Then the binding wire is inserted into the split groove formed at an end of the twisting shaft. When the twisting shaft is rotated, the wire inserted into the split groove is twisted. Due to the twisting motion of the wire, the wire loop diameter is reduced, so that the reinforcing bars are tightly bound by the wire. After the completion of binding, the binding machine is drawn to the operator's side, and the wire is disengaged from the split groove of the twisting shaft. Since a distance between the wire twisting portion formed in the split groove and the reinforcing bars is always maintained constant, there is no possibility that a long wire twisting portion rises from the wire loop.

BRIEF DESCRIPTION OF THE DRAWINGS

FIGS. 7(*a*), 7(*b*) and 7(*c*) are schematic illustrations showing a binding condition of the conventional reinforcing bar binding machine;

DETAILED DESCRIPTION OF THE PREFERRED EMBODIMENTS

Figure 1:
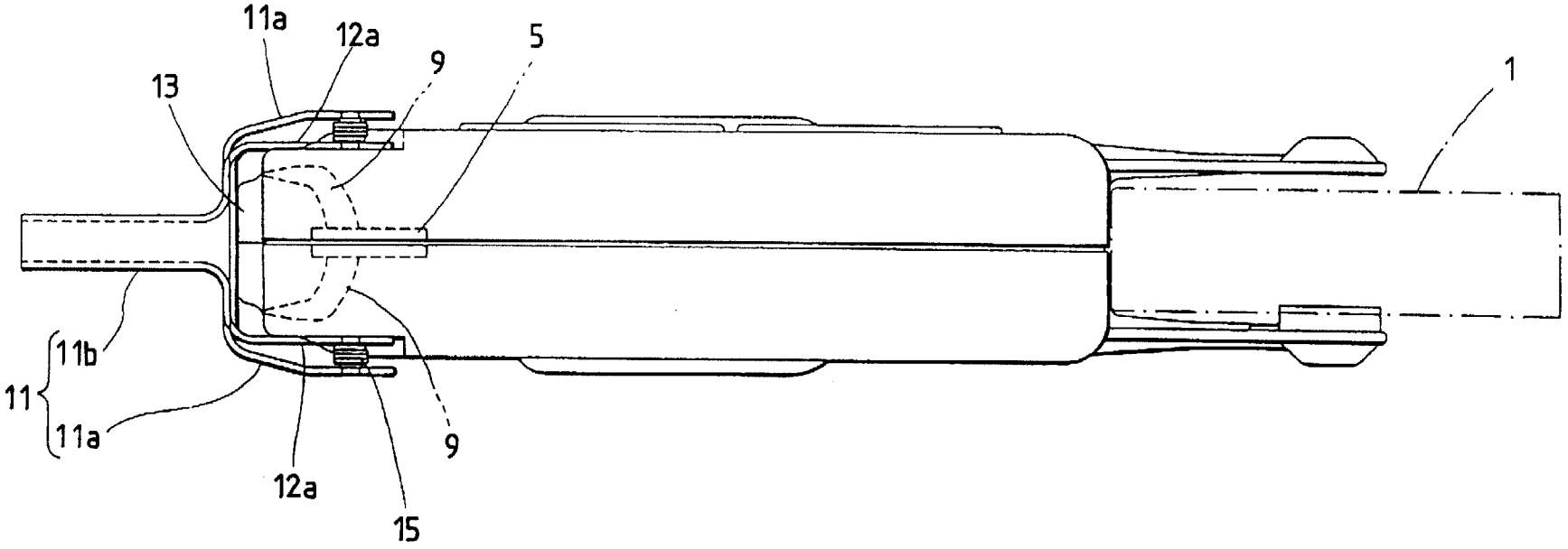
FIG. 1 is a plan view showing a reinforcing bar binding machine of the present invention.
Figure 2:
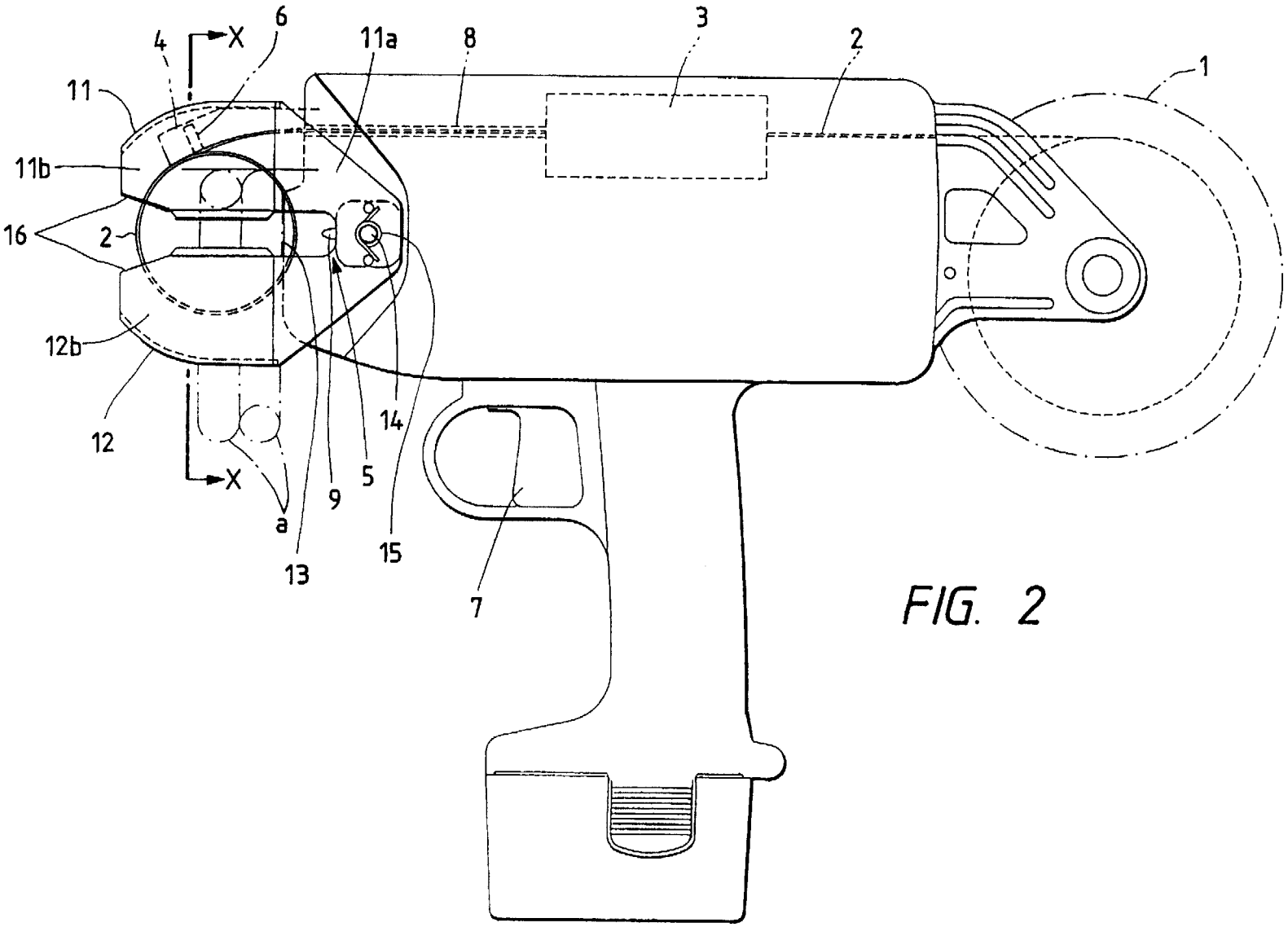
FIG. 2 is a side view showing an outline of the reinforcing bar binding machine of the present invention.

FIGS. 1 and 2 are views showing a portion of the reinforcing bar binding machine of an embodiment of the present invention. This reinforcing bar binding machine includes: a wire feed device 3 for feeding a wire 2 wound around a spool 1; a guide portion 4 for guiding the wire 2, which has been fed from the spool 1, so that the wire 2 can be wound around a crossing portion of the reinforcing bars "a"; a twisting device 5 for holding and twisting a portion of a loop of the wound wire 2; and a cutting device 6 for cutting off the loop from the primary wire 2. When the trigger 7 is pulled, the operation of this binding machine is conducted as follows. The wire 2 is sent by the wire feed device 3 from the spool 1 to the guide portion 4 via the feed path 8. After the wire 2 has been wound around the reinforcing bars "a" in a loop-shape, a portion of the loop is held and twisted by the twisting hook 9 of the twisting device 5, so that the reinforcing bars "a" can be bound, and at the same time the loop is cut off from the primary wire 2 by the cutting device 6. In this arrangement, the wire feed device 3, twisting device 5 and cutting device 6 are driven by a motor not shown in the drawing. These fundamental arrangements and mode of operation are similar to those of Japanese Utility Model Application Laid-open No. 5-3494 described before.

Figure 3:
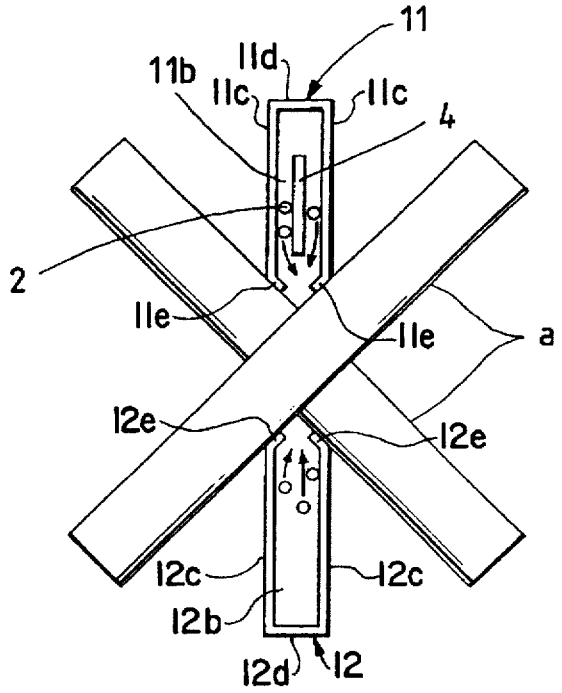
FIG. 3 is an enlarged cross-sectional view taken on line X—X in FIG. 2.

In this connection, the guide portion 4 for guiding the wire 2 continues to the extension of the feed path 8 of the binding machine. The guide portion 4 protrudes to the front end of the reinforcing bar binding machine, and the end of the guide portion 4 is curved downward. In the guide portion 4, there is formed a guide groove 10 (shown in FIG. 3), the size of which is a little larger than that of one piece of wire. After the wire 2 has been guided out from the feed path 8, it is continuously curved by the guide groove 10 so that a predetermined radius of curvature can be provided on the wire 2. In this way, the wire 2 is wound around the reinforcing bars in a loop-shape. The wire cutting device 6 is disposed in the guide portion 4.

In this reinforcing bar binding machine, there is provided a guide device for guiding the loop-shaped wire 2 so that the wire 2 can not be shifted in a direction perpendicular to the radial direction of the wire loop. This guide device includes a first guide arm 11 disposed in the front of the twisting hook 9 and a second guide arm 12, wherein the first and the second guide arms 11, 12 are opposed to each other. In the guide device, there is provided a block-shaped contact portion 13 which comes into contact with the crossing portion of the reinforcing bars "a".

The first guide arm 11 includes: a plate-shaped supporting portion 11*a*, the shape of which is formed into a C-shape when the view is taken on a plane; and a guide groove portion 11*b* having a C-shape in section, being open at the lower portion thereof and protruding to the front from the center of the plate-shaped supporting portion 11*a*. The plate-shaped supporting portion 11*a* is rotatably supported by a support shaft 14 provided on both sides of the front end of the reinforcing bar binding machine body. The first guide arm 11 is disposed in such a manner that the guide portion 4 is surrounded by the first guide arm 11. Inside the guide groove portion 11*b*, the loop-shaped wire 2 is guided and held.

The second guide arm 12 includes: a plate-shaped supporting portion 12*a*, the shape of which is formed into a C-shape when the view is taken on a plane; and a guide groove portion 12*b* having a C-shape in section, being open at the upper portion thereof and protruding to the front from the center of the plate-shaped supporting portion 12*a*. Inside the guide groove portion 12*b*, the loop-shaped wire 2 is guided and held. The above plate-shaped supporting portion 12*a* is rotatably supported by the above support shaft 14.

In this connection, the first guide arm 11 and the second guide arm 12 are attached to the common support shaft 14 in such a manner that they can be freely opened and closed in the upward and downward direction. Both guide arms 11, 12 are urged in the closing direction by a spring 15. There are respectively provided oblique guide portions 16 in the end opposing portions of the first and the second guide arm 11, 12, so that the opposing portions of the first and the second guide arm 11, 12 are expanded when the guide arms are placed over the reinforcing bars "a". Due to the foregoing, the opening angle formed between the first guide arm 11 and the second guide arm 12 can be freely adjusted.

The contact portion 13 comes into contact with the crossing portion of the reinforcing bars "a" in the process of binding. The contact portion 13 is arranged in the front of the twisting hook 9 so that the reinforcing bars "a" can not be directly contacted with the twisting hook 9. In this connection, it is preferable to arrange a sensor (not shown in the drawing) in the contact portion 13 so that the reinforcing bars "a" can be detected to operate the reinforcing bar binding machine.

Figure 4:
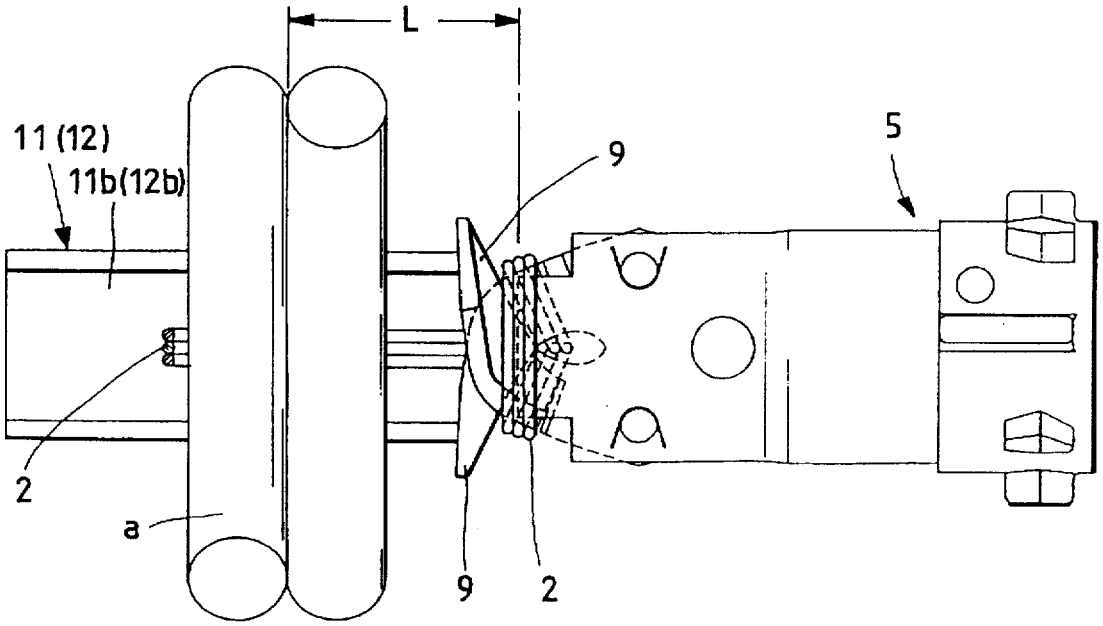
FIG. 4 is a schematic illustration for explaining the operation of the twisting hook.

The above reinforcing bar binding machine operates as follows. The crossing portion of the reinforcing bars "a" is inserted and pushed between the oblique guide portions 16 formed at the ends of the first and the second guide arm 11, 12 of the reinforcing bar binding machine. When the reinforcing bars "a" come into contact with the contact portion 13, the sensor detects the contact, so that the binding machine is put into an operating condition. When the trigger 7 is pulled at this time, the wire feed device 3 is operated, and the wire 2 wound around the spool 1 is fed out and wound around the crossing portion of the reinforcing bars "a" by the guide portion 4 in a loop-shape. In the same manner, the wire 2 is wound around the crossing portion in a loop-shape in the second, third and fourth turns. The wire 2, which has been wound in a loop-shape, is accommodated inside the guide groove 11*b*, defined by two radially extending, substantially parallel portions 11*c* connected at an outer edge thereof by transverse portion 11*d*, of the first guide arm 11 and the guide groove 12*b*, defined by two radially extending, substantially parallel portions 12*c* connected at an outer edge thereof by transverse portion 12*d*, of the second guide arm 12. After the wire 2 has been wound around the crossing portion of the reinforcing bars "a" by three or four turns, the feed device 3 is stopped and the cutting device 6 is operated so as to cut off the wire 2 in the guide portion 4. Simultaneously, the twisting device 5 is operated as shown in FIG. 4, and the twisting hook 9 is closed so that a portion of the wire loop 2 is held and twisted. Due to the foregoing operation, the crossing portion of the reinforcing bars "a" is strongly bound by the wire 2. After the completion of binding, the reinforcing bar binding machine is drawn to the operator's side, and the twisting hook 9 is drawn out from the wire 2 and opened, so that the reinforcing bars "a" can be maintained in a binding condition.

Each guide arm 11 and 12 preferably includes opposed beveled edge flanges 11*e* and 12*e*, respectively. Beveled edge flanges 11*e* and 12*e* preferably extend inwardly and toward one another from the inner periphery of parallel portions 11*c* and 12*c*, respectively. As can be appreciated from FIG. 3, flanges 11*e* and 12*e* engage each of the mutually crossed reinforcing bars at crossing section "a" so as to orient each guide arm 11, 12 by a wedging action into the bar crossing section to further insure that the wire loop is formed directly over the crossing of the two reinforcing bars.

When the wire 2 is twisted by the twisting hook 9 as described above, the wire loop 2 is given a force by which the wire 2 is laterally shifted in the direction perpendicular to the radial direction of the wire loop. However, as shown in the drawing, since the wire loop is held in the guide groove 11*b* of the first guide arm 11 and the guide groove 12*b* of the second guide arm 12, the wire loop is not shifted in the transverse direction. Accordingly, comparing to the conventional reinforcing bar binding machine, even if the reinforcing bar binding machine is not drawn to give a tension to the wire 2, the occurrence of a faulty binding can be avoided.

Figure 5:
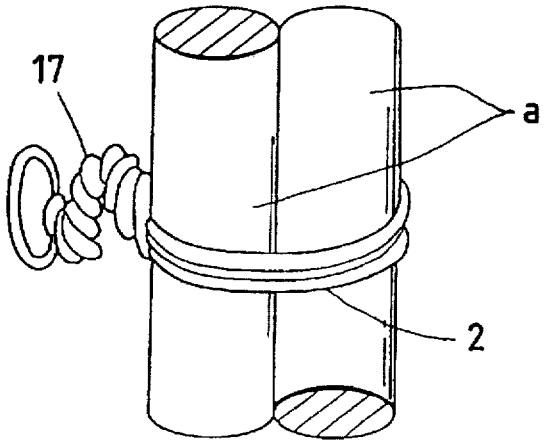
FIG. 5 is a perspective view showing a binding condition of reinforcing bars.

It is not necessary to give a tension to the binding wire 2 by separating the reinforcing bar binding machine from the crossing portion of the reinforcing bars "a". Accordingly, a distance L between the wire 2 twisting portion of the twisting hook 9 and the crossing portion of the reinforcing bars "a" can be maintained constant at all times, that is, the distance L is not extended, and as shown in FIG. 5, the length of the twisting portion 17 of the wire 2 can be reduced. In other words, with contrast to the conventional reinforcing bar binding machine, the rising portion of the twisted wire is not long. Therefore, it is not necessary to pull down the rising portion of the twisting wire after the completion of binding.

Figure 6:
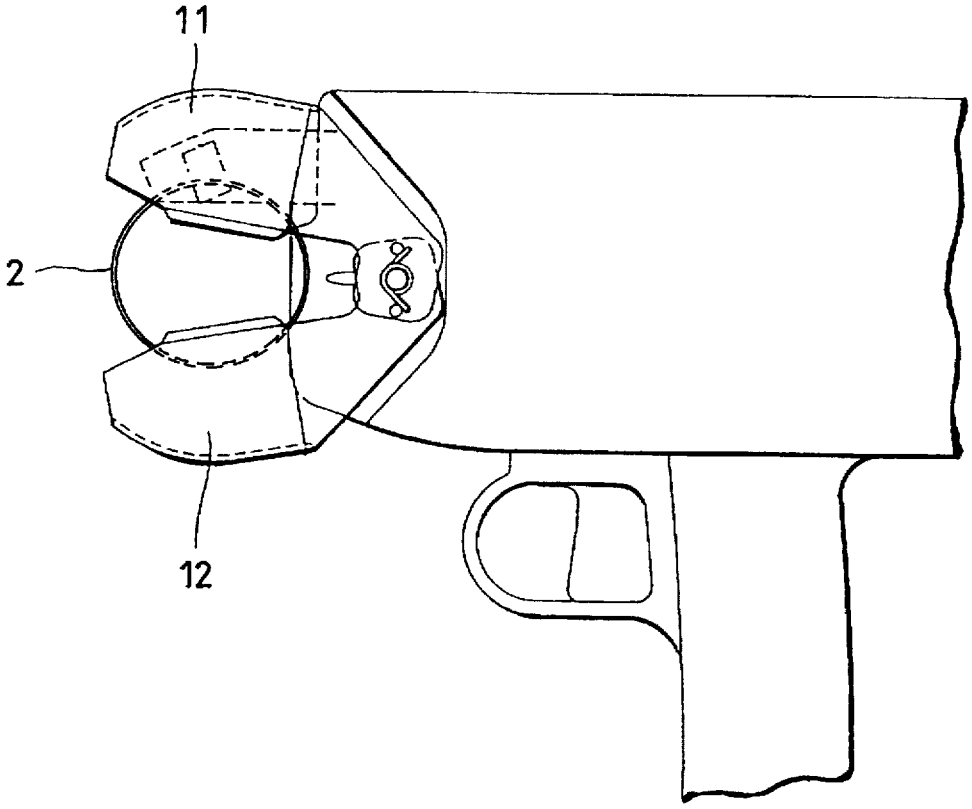
FIG. 6 is a side view showing the first and the second arm which are opened.

In this connection, diameters of the reinforcing bars "a" vary from the large to the small. However, since the opening angle formed between the first guide arm 11 and the second guide arm 12 is adjustable as shown in FIG. 6, the wire 2 can be automatically maintained in the best condition between the first guide arm 11 and the second guide arm 12 in accordance with the diameters of the reinforcing bars. In this case, the best condition is defined as a condition in which a portion of the wire not held by the guide grooves of both guide arms 11, 12 is minimum.

Figure 8:
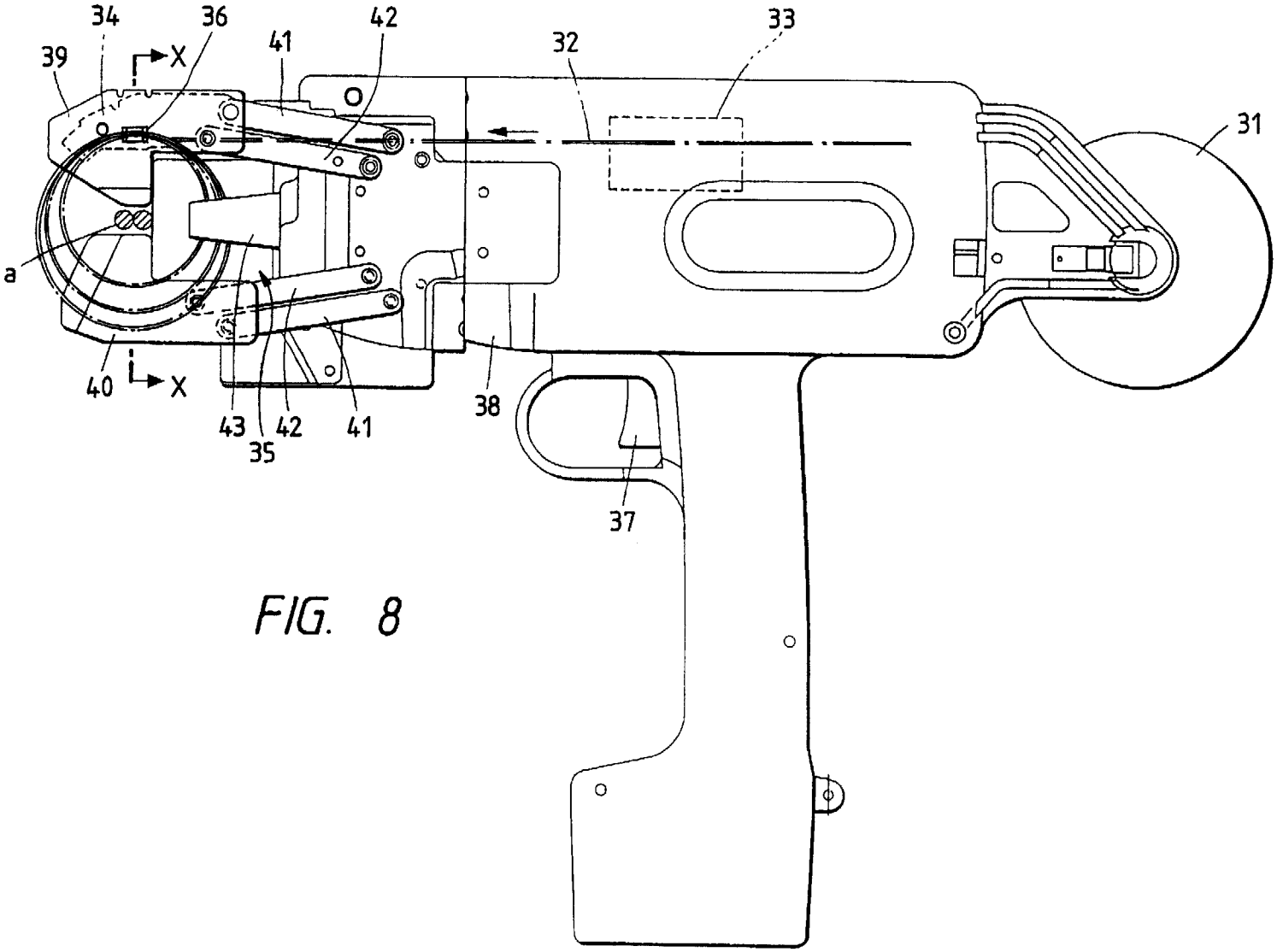
FIG. 8 is a side view showing another reinforcing bar binding machine of the present invention.
Figure 9:
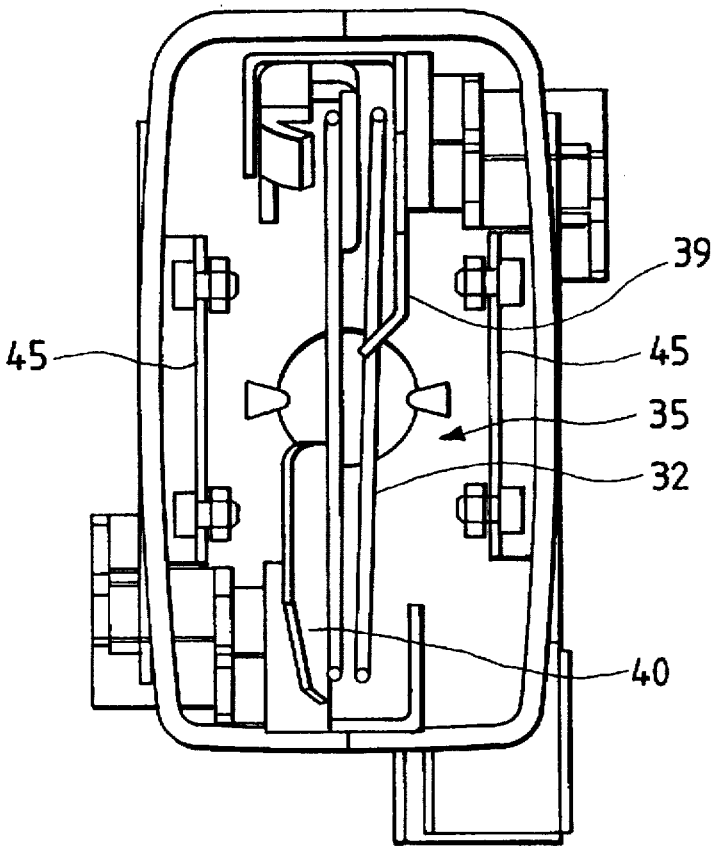
FIG. 9 is a cross-sectional view taken on line X—X in FIG. 8.

FIGS. 8 and 9 are views showing a portion of the reinforcing bar binding machine of another embodiment. This reinforcing bar binding machine includes: a wire feed device 33 for feeding a wire 32 wound around a spool 31; a guide portion 34 for guiding the wire 32, which has been fed from the spool 31, so that the wire 32 can be wound around a crossing portion of the reinforcing bars "a"; a twisting device 35 for holding and twisting a portion of a loop of the wound wire 32; and a cutting device 36 for cutting off the loop from the primary wire 32. When the trigger 37 is pulled, the wire 32 is sent out from the wire feed device 33 and wound around the reinforcing bars "a" in a loop-shape and then cut by the cutting device. Then a portion of the loop is held and twisted by the twisting device 35. In this way, the wire 32 is twisted, so that the reinforcing bars "a" can be tightly bound by the wire. In this arrangement, the wire feed device 33, twisting device 35 and cutting device 36 are driven by a motor not shown in the drawing. These fundamental arrangements and mode of operation are also similar to those of Japanese Utility Model Application Laid-open No. 5-3494 described before.

In the binding machine body 38, there are provided a pair of guide arms 39, 40 which are opposed to each other in the upward and downward direction, and the loop-shaped wire 32, which has been sent out from the guide portion 34, is held inside the guide arms 39, 40 so that the loop-shaped wire 32 can not be shifted in a direction perpendicular to the radial direction of the loop.

In this connection, the guide arms 39, 40 are connected to the binding machine body 38 via two parallel links 41, 42, and a distance between the guide arms 39, 40 can be adjusted in accordance with the size of the reinforcing bar.

Figure 10A:
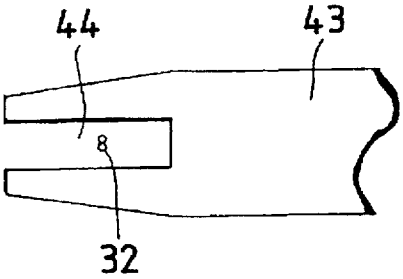
FIGS. 10(*a*) and 10(*b*) are respectively a side and a front view of the twisting shaft.
Figure 10B:
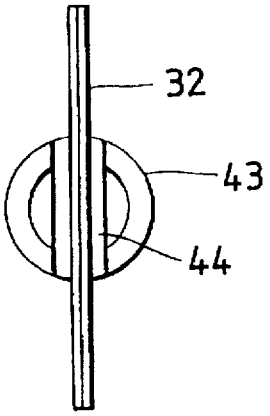

As shown in FIGS. 10(*a*) and 10(*b*), the twisting device 35 is arranged as follows. A twisting shaft 43 protruding from the binding machine body is disposed in the radial direction of the loop-shaped wire 32, wherein the twisting shaft 43 can be rotated around the axis. There is provided a split groove 44 at the end of the twisting shaft 43. The split groove 44 is formed in such a manner that the loop-shaped wire 32 can be inserted into the split groove 44.

The twisting shaft 43 is formed in such a manner that a diameter of the twisting shaft 43 is gradually reduced as it comes to the end. In this connection, the twisting shaft 43 is not limited to a circular-rod-shape, but the twisting shaft 43 may be formed into a square-rod-shape which is tapered.

Figure 11A:
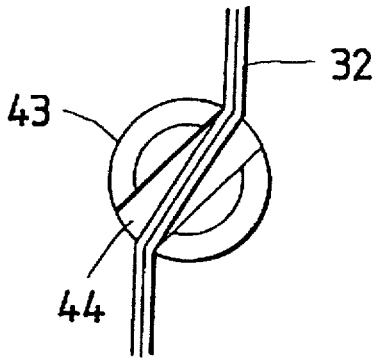
FIGS. 11(*a*) and 11(*b*) are schematic illustrations showing a condition in which the wire is twisted by the twisting shaft.
Figure 11B:
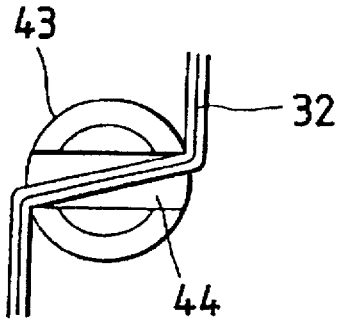
Figure 12:
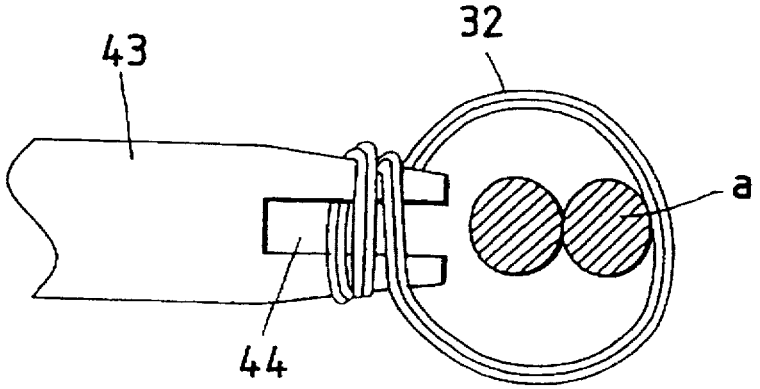
FIG. 12 is a schematic illustration showing a condition in which the wire is twisted by the twisting shaft.

Next, the operation of the reinforcing bar binding machine described above will be explained as follows. The crossing portion of the reinforcing bars "a" is introduced between the guide arms 39, 40, and contact portions 45 provided on both sides of the reinforcing bar binding machine are pressed against the crossing portion of the reinforcing bars "a", and the trigger 37 is pulled. Then the wire feed device 33 is operated, and the wire 32 wound around the spool 31 is sent out and wound in a loop-shape around the crossing portion of the reinforcing bars "a" by the action of the guide portion 34 by a plurality of times. At this time, the wire 32 is inserted into and accommodated in the split groove 44 formed at an end of the twisting shaft 43 (shown in FIGS. 10(*a*) and 10(*b*)). After that, the twisting shaft 43 is rotated. Then the wire inserted into the split groove 44 is twisted as shown in FIGS. 11(*a*) and 11(*b*). Since the wire 32 is twisted in this way, a diameter of the loop of the wire 32 is reduced, and the reinforcing bars are tightly bound as shown in FIG. 12. After the completion of binding, the binding machine is drawn to the operator's side, and the wire 32 is disengaged from the split groove 44 of the twisting shaft 43. Since a distance between the wire twisting portion formed in the split groove 44 and the reinforcing bars is always maintained constant, there is no possibility that a long wire twisting portion rises from the wire loop.

In this connection, since the diameter of the twisting shaft 43 is gradually reduced as it comes to the end, the twisting shaft 43 can be easily disengaged from the wire 32 after the completion of binding.

When the wire 32 is twisted and rotated by the twisting shaft as described above, the wire loop 32 is given a force so that it is shifted in a transverse direction perpendicular to the radial direction of the wire loop. However, the wire loop 32 is not shifted in the transverse direction since the upper and lower guide arms 39, 40 hold the wire loop 32.

According to the invention described above, unlike the conventional twisting means, the opening and closing operation is not required, and the linear movement is not required either. Only the rotational operation is required for twisting the binding wire. Accordingly, the shape and structure of the twisting shaft can be simplified, and the weight and size of the twisting shaft can be reduced. Further, no wire twisting portion rises from the wire loop. Accordingly, it is not necessary to pull down the rising portion after the reinforcing bars have been bound. Therefore, the operation speed is increased.

Furthermore, the diameter of the twisting shaft is gradually reduced as it comes to the end. Therefore, the wire can be easily disengaged from the twisting shaft after the wire has been twisted. Consequently, the working property can be enhanced.

We claim:

1. A wire winding guide for a reinforcing bar binding machine in which reinforcing bars are bound with a wire, said wire winding guide comprising:

a wire feed device for feeding the wire to bind the reinforcing bars;

a guide portion for curling the wire fed out from said wire feed device so as to form the wire into a loop;

a twisting hook for holding a portion of the wire loop and twisting the wire;

a cutting device for cutting off the loop of the wire from a remaining portion of the wire;

a first and a second guide arm for guiding and holding the loop-shaped wire fed out from said guide portion, said first and the second guide arm being constructed and arranged to be movable between an opened position for permitting said first and second guide arms to be positioned over and removed from reinforcing bars to be bound and a closed position wherein said first and second guide arms are moved toward one another so as to engage the reinforcing bars to be bound, wherein said first and the second guide arms are arranged in the front of said twisting hook being opposed to each other and wherein at least one of said first and second guide arms includes opposed beveled edge flanges extending from an inner periphery of said at least one guide arm for engaging crossed reinforcing bars so as to orient said first and second guide arms over a crossed section of the crossed reinforcing bars to be bound when said first and second guide arms are in the closed position; and a contact portion arranged close to said twisting hook, coming into contact with a crossing portion of the reinforcing bars in the process of binding.

2. The wire winding guide according to claim 1, wherein said first and the second guide arm are constructed and arranged to be urged toward said closed portion at all times.

3. The wire winding guide according to claim 1, wherein each of said first and second guide arms includes two radially extending, substantially parallel portions connected at an outer edge thereof by a transverse portion, said substantially parallel portions and said transverse portion defining a guide groove for guiding the wire loop and restricting lateral movement of the wire loop while the wire loop is being twisted by said twisting hook.

* * * * *